United States Patent [19]

Hutto

[11] Patent Number: 4,896,381

[45] Date of Patent: Jan. 30, 1990

[54] COMBINATION PLASTER GUARD AND MOUNTING BRACKET FOR MIXING VALVE

[75] Inventor: Joe D. Hutto, Fort Myers, Fla.

[73] Assignee: Masco Corporation of Indiana, Taylor, Mich.

[21] Appl. No.: 164,753

[22] Filed: Mar. 7, 1988

[51] Int. Cl.[4] ..... E03C 1/00

[52] U.S. Cl. ..... 4/191; 137/359; 137/360

[58] Field of Search ..... 4/191, 192, 654, 655, 4/657, 658, DIG.18; 137/359, 360, 377, 379; 215/253; 220/276

[56] References Cited

U.S. PATENT DOCUMENTS

| | | | |
|---|---|---|---|
| 35,515 | 6/1862 | Gibson et al. | 137/359 |
| 1,456,841 | 5/1923 | Brown | 4/191 X |
| 2,646,818 | 7/1953 | Bimpson | 137/377 |
| 2,708,449 | 5/1955 | Keithley | 137/359 |
| 3,107,686 | 10/1963 | Cowdrey | 4/191 X |
| 3,278,201 | 10/1966 | Noland | 4/191 X |
| 3,331,386 | 7/1967 | Politz | 137/359 |
| 3,735,776 | 5/1973 | Graversen et al. | 137/359 |
| 3,809,365 | 5/1974 | Loffler | 215/253 |
| 3,976,215 | 8/1976 | Smalley | 215/253 |
| 4,185,334 | 1/1980 | Izzi | 4/191 |
| 4,206,779 | 6/1980 | Sandstrom | 137/360 |
| 4,353,139 | 10/1982 | Wainwright et al. | 4/DIG. 18 |
| 4,709,429 | 12/1987 | Lerner et al. | 4/DIG. 18 |

FOREIGN PATENT DOCUMENTS

| | | | |
|---|---|---|---|
| 67343 | 12/1982 | European Pat. Off. | 4/191 |
| 2307617 | 8/1973 | Fed. Rep. of Germany | 4/191 |
| 2413177 | 12/1974 | Fed. Rep. of Germany | 4/191 |

*Primary Examiner*—Stephen Marcus
*Assistant Examiner*—Christine A. Peterson
*Attorney, Agent, or Firm*—Steven L. Permut; Malcolm L. Sutherland

[57] ABSTRACT

The combination plaster guard and mounting bracket (10) has a mounting bracket section (12) which is mounted to a mixing valve fitting (18). A tubular protective member (14) is connected to the mounting section via frangible tabs (24). The tubular member (14) is sized to receive and protect the mixing valve (16) during installation of the valve and construction of the surrounding wall. During certain installations, it is desirable for removal of the tubular member from the mounting section. The removal can be accomplished by rotation of the tubular member so that frangible tabs (24) break to release the tubular member from the bracket section (12).

10 Claims, 4 Drawing Sheets

COMBINATION PLASTER GUARD AND MOUNTING BRACKET FOR MIXING VALVE

TECHNICAL FIELD

This invention relates to a protective plaster guard and mounting bracket combination for a shower and tub mixing valve. The plaster guard provides protection for the mixing valve during installation and subsequent construction of the surrounding wall and also provides a mounting structure for certain installations to help secure the mixing valve in place.

BACKGROUND OF THE INVENTION

Faucet valves for showers and bathtubs commonly have a body with a highly polished chrome plated surface or similarly finely prepared surface such as polished brass, antique brass, colored plastic, vinyl or enamel. However, with new construction, the faucet valves are often installed before finished walls are installed. Consequently, the faucet valve surface must be protected against any further construction that can easily cause damage to the surface of the faucet valve.

Consequently, protection of the faucet valve is necessary against accidental nicks, dents and scratching. This protection is provided by a plastic protector commonly referred to as a plaster guard which has a planar base section that has mounting holes for receiving fasteners which engage the faucet valve fitting and a tubular section which receives the faucet valve body. The plaster guard stays mounted with the faucet valve during plastering and finishing of the wall. The wall is plastered flush with a planar base section of the protector. After the wall is finished, the fasteners are removed and the plaster guard is discarded. An escutcheon is mounted over the hole in the plaster wall formed by the plaster guard and the faucet valve handle is mounted onto the valve to complete the installation.

The plaster guard, however, up to now has been limited to the standard installation of a wall with standard tile and it is not adaptable for either extra thick tile or fiberglass and plastic shower and bath units which are becoming popular. Because the standard plaster guard is not useful during certain installations, the plaster guard is often discarded and a cardboard tube from a toilet paper roll or paper towel roll is slipped over the faucet valve for these special installations.

What is needed is a combination mounting bracket and plaster guard which maintains the protective abilities of the previously known plaster guard and is adaptable for various faucet installations including special thick tile, and fiberglass and plastic shower and bath units.

SUMMARY OF THE INVENTION

In accordance with one aspect of the invention, a combination plaster guard and mounting bracket for a shower and bath faucet valve includes a mounting bracket section having mounting means for mounting onto a section of the faucet valve assembly. Preferably, the mounting means includes two legs having apertures therethrough for receiving fasteners which can be fastened to a rear section of the faucet valve assembly. The rear section can be a valve fitting which in turn is secured to the faucet valve housing to form a faucet valve assembly. Preferably, the fasteners engage threaded apertures in an adapter that is secured to the faucet valve fitting.

The mounting bracket section preferably has an inner cylindrical ring and an outer cylindrical ring that are fixedly secured together. A supporting web portion spans the space between the two rings to connect the two rings together. In addition, radially extending ribs connect the two cylindrical rings. The mounting bracket section has an opening therethrough for receiving the faucet valve.

A tubular member extends from the mounting bracket section and is generally co-aligned with the opening and sized to receive the faucet valve and to extend axially beyond the front end of the faucet valve. The tubular member is releasably connected to the mounting bracket section so that the tubular member can be disconnected from the mounting bracket section and removed from about said faucet valve. Preferably, the tubular member is integrally formed with the mounting bracket section. Connecting means for releasably connecting the tubular member include integrally formed frangible tabs interposed between the mounting bracket section and the tubular member.

The tubular section has an outer diameter slightly smaller than the diameter of the opening in the mounting bracket section so an annular clearance is formed therebetween. Preferably the tabs extend radially through the annular clearance from the inner edge of the opening toward the tubular section.

In accordance with one embodiment of the invention, the mounting bracket section has an integrally formed support flange extending rearwardly and having a rear edge shaped to conform against a faucet valve fitting so that in conjunction with the mounting legs the support flange maintains alignment of the mounting legs with the threaded apertures in the adapter. The mounting bracket section has its integrally formed support flange being an extension of the inner cylindrical ring. The support flange has two rearwardly protruding fingers that abut an upper side of the faucet valve fitting such that the faucet valve fitting is interposed between said two fingers and the mounting legs.

Preferably the web portion between the two cylindrical rings has two gaps between two pairs of support ribs to allow roughing in of the faucet valve on a stringer before connection of the valve to plumbing pipes. A screwdriver can extend through each gap in the mounting bracket to drive in screws through the faucet valve adapter to mount the mixing valve on a horizontal piece of wood called a stringer which in turn is secured to adjacent studs.

In a certain embodiment, a second tube extends from the web of the bracket section and is sized to receive a diverter valve stem. The second tube is also releasably connected to the bracket section in the same fashion as the before mentioned tubular member.

The combination plaster guard and mounting bracket can be used for standard faucet installation in a plaster and tile wall. It can also be used for extra thick tile walls and for a faucet installation in a fiberglass or plastic shower wall. The plaster guard can be used for a tub and shower mixing valve or separate tub and shower hot and cold valves.

The combination plaster guard and mounting bracket with the removable tubular member allows for greater adaptability in mounting a tub and shower faucet valve in a variety of installations and installation procedures. This greater adaptability is needed with the advent of fiberglass bath units and extra thick tile used in bathroom settings. This adaptability is achieved without jeopardizing the protective ability of the plaster guard and mounting bracket with respect to the faucet valve.

BRIEF DESCRIPTION OF THE DRAWINGS

Reference now will be made to the accompanying drawings in which.

DETAILED DESCRIPTION OF THE PREFERRED EMBODIMENT

Figure 1:
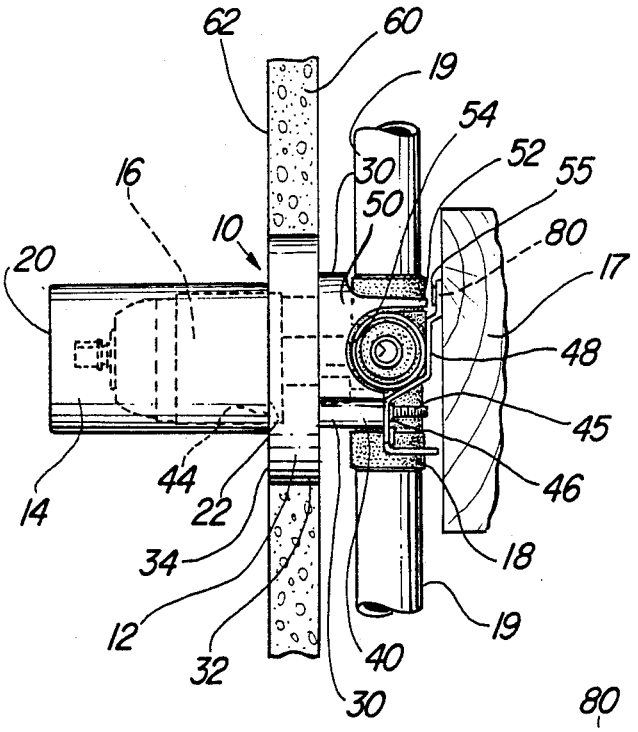
FIG. 1 is a side elevational and partially sectional view of a mixing valve with a combination plaster guard and mounting bracket thereon installed in place with a standard roughed-in wall.
Figure 2:
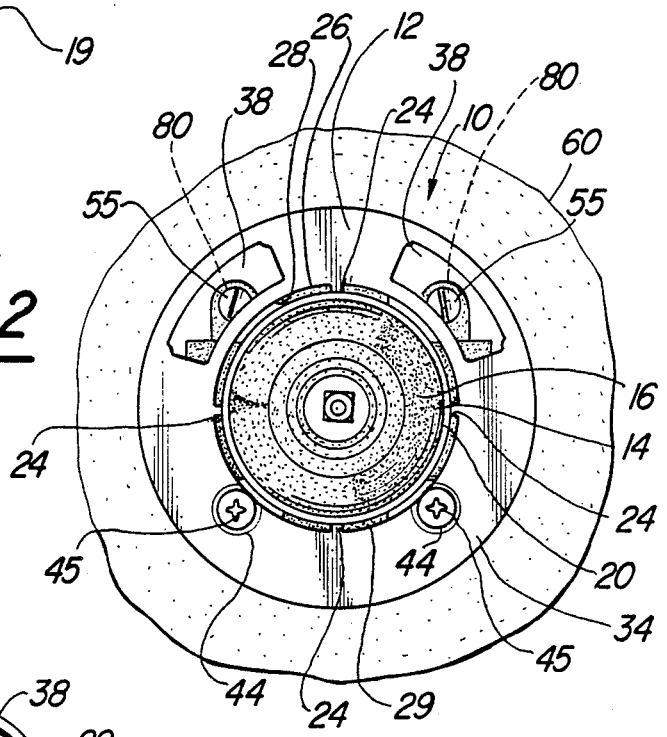
FIG. 2 is an enlarged front elevational view thereof.
Figure 3:
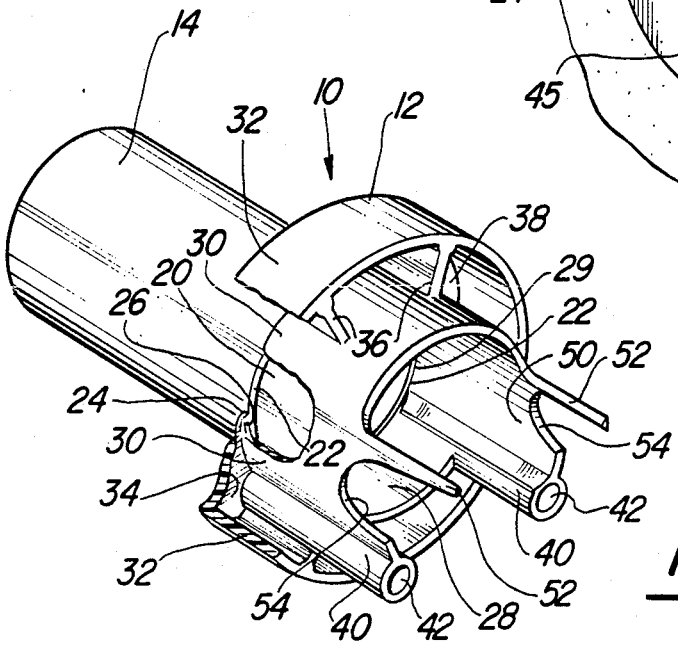
FIG. 3 is an enlarged rear perspective and partially sectional view of a combination plaster guard and mounting bracket.

Referring now to FIGS. 1-3, a combination plastic guard and mounting bracket 10 has a mounting bracket section 12 and a tubular member 14. At the factory, the member 10 is fitted onto and over a faucet valve 16, for example a mixing valve, for protecting the valve during handling and shipping. In addition, the mixing valve 16 is protected from scratches and denting during installation and subsequent construction. More particularly, the member 10 is mounted onto a rear section of the mixing valve 16 in the form of a valve fitting 18. The fitting 18 is roughed in and mounts to a stringer 17 as explained in detail later and can then be mounted to appropriate piping 19.

The tubular member 14 has a central aperture 20 sized to receive the mixing valve 16. The one end 22 of the tubular member has radially extending frangible tabs 24 which attach the tubular member 14 to the inner edge 26 of the mounting bracket section 12 which defines a central aperture 28 within the mounting bracket section 12. An annular clearance 29 is formed between the edge 26 and tubular member 14.

The mounting bracket section 12 has an annular web section 34 spanning the space between an inner cylindrical ring 30 and outer cylindrical ring 32 at one end thereof. The web section 34 is referred to as the front end of the mounting bracket section. In addition, support ribs 36 radially extend between the inner cylindrical ring 30 and outer cylindrical ring 32. Annular web section 34 has two windows 38 which are interposed between two pairs of radial support ribs.

Mounting legs 40 extend rearwardly from the web section 34 adjacent the inner cylindrical ring 30. Each mounting leg 40 has an aperture 42 and countersink opening 44 in the web section 34. The aperture 42 and countersink 44 are sized to receive threaded fasteners 45 such as a screw or bolt. The mounting legs are positioned such that the apertures 42 are aligned with apertures 46 in the mixing valve fitting adapter 48 which is fixedly attached to the fitting 18.

Extending rearwardly from the inner cylindrical ring 30 is a support flange 50 which conforms to the inner cylindrical ring and extends rearwardly therefrom. The support flange 50 has two elongated fingers 52 which are positioned to abut an upper surface of the mixing valve fitting 18 and spaced from the mounting legs. The rest of the support flange 50 has an indented notch 54 to receive the mixing valve fitting 18 between the mounting legs 40 and the fingers 52.

Figure 10:
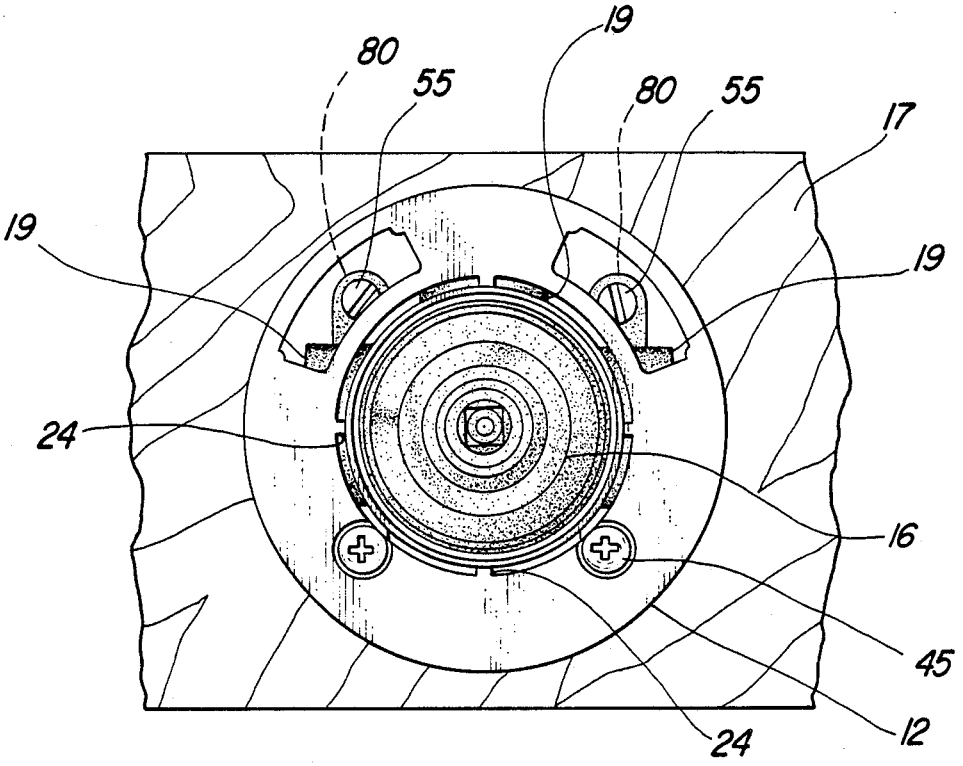
FIG. 10 is an enlarged front view of a mixing valve with a combination plaster guard and mounting bracket roughed in with a stringer.

Referring now to FIGS. 1, 2 and 10, the combination plaster guard and mounting bracket 10 is connected by bolts 45 to the valve 16 and fitting 18 at the factory and shipped as an assembly. The valve assembly can be roughed in place by positioning the valve assembly between two studs of an unfinished wall before the plumbing pipes 19 are installed in position. Screws 55 are threaded into apertures 80 within adapter 48. A screwdriver can be passed through the windows 38 in the amounting section for engaging the screws 55. These screws 55 are secured to the horizontally placed stringer 17 which is a horizontally mounted piece of wood mounted between two studs. The screws 55 secure the mixing valve assembly in place until the pipes are then installed within the construction site and attached to the faucet valve fitting 18.

Figure 5:
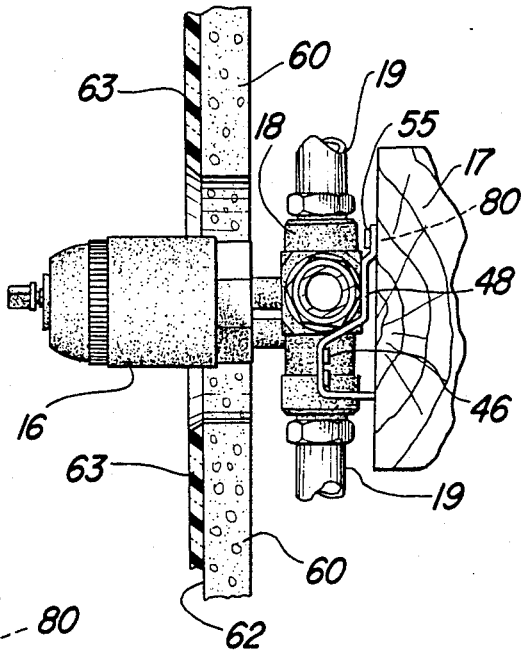
FIG. 5 is a view similar to FIG. 1 with a combination plaster guard and mounting bracket entirely removed from the installed mixing valve.

Plaster wall 60, as shown in FIGS. 1 and 2, is then constructed about the outer cylindrical ring 32 of the mounting bracket section 12. Preferably the annular web section 34 is flush with the outer surface 62 of wall 60. After the wall 60 is constructed and a tile covering 63 is secured thereto, the threaded screws 45 can be unscrewed from the mounting bracket and the entire combination plaster guard and mounting bracket 10 can be removed as shown in FIG. 5. Trim such as an escutcheon plate and faucet handle (not shown) can then be installed in a conventional fashion.

Figure 4:
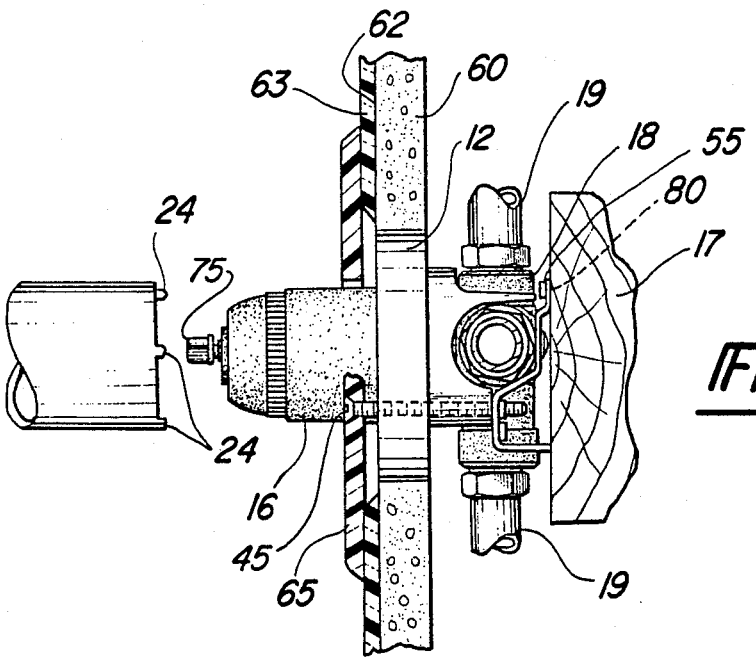
FIG. 4 is a view similar to FIG. 1 with the plaster guard removed from the mounting bracket and the escutcheon plate installed.

If desired, the mounting bracket section 12 can remain in place as shown in FIG. 4. The tubular member 14 may be removed by twisting such that the frangible tabs 24 are broken. The screws 45 can then be removed and the escutcheon plate 65 installed in place with the screws 45 remounted through the escutcheon plate 65 and legs 40 threadably engaged in the apertures 46 of adapter 48. A handle (not shown) can then be installed on stem 75.

Figure 6:
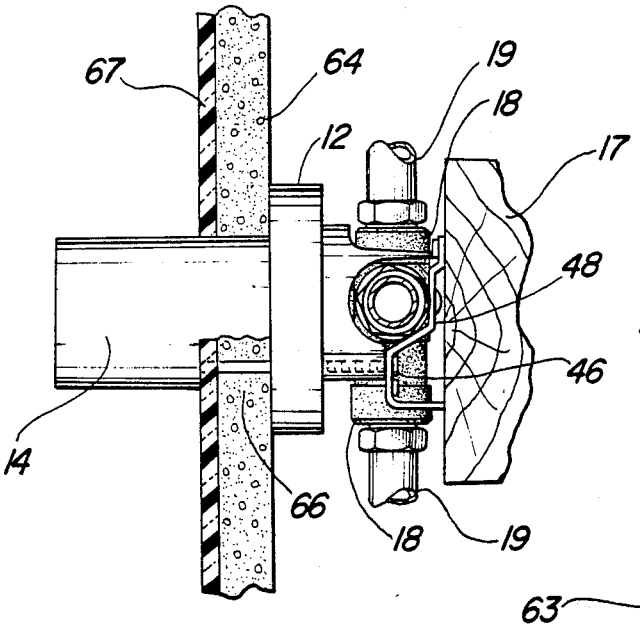
FIG. 6 is a side view similar to FIG. 1 showing a variation in roughing in of the wall and tiling of the wall about the installed mixing valve and plaster guard.
Figure 7:
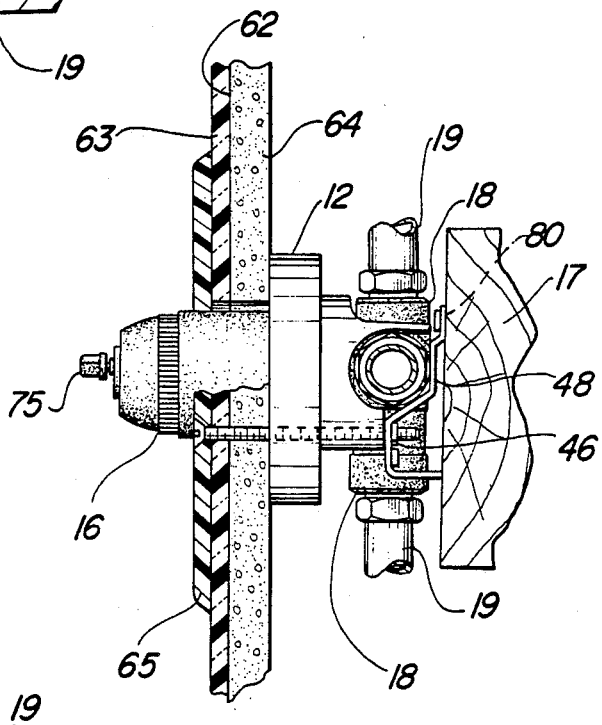
FIG. 7 shows a view similar to FIG. 6 with the mixing valve and escutcheon plate fully installed.

An alternate installation may be desirable depending on the axial positioning of the mixing valve with respect to the proposed wall. As shown in FIGS. 6 and 7, a wall 64 can be constructed in front of the mounting bracket section 12 and about the small tubular member 14. After construction of the wall 64 and addition of a tile covering 67 thereon, the tubular member 14 can be twisted and broken away such that the frangible tabs 24 are broken. Holes 66 are drilled through wall 64 and tile covering 67 to expose the screws 45 which can then be removed as shown in FIG. 6. The escutcheon plate 65 can then be mounted in position by the screws 45 as shown in FIG. 7. A handle (not shown) can then be installed on stem 75.

Figure 8:
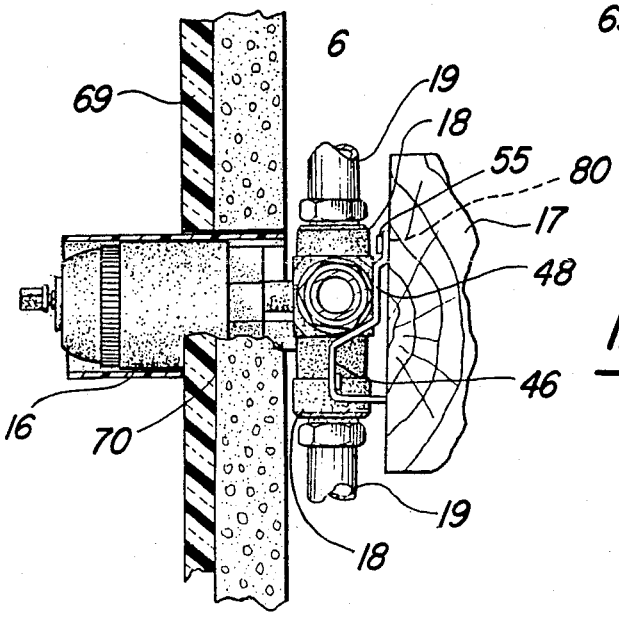
FIG. 8 is a side and partially sectioned view of the installed mixing valve using the plaster guard member with the installation of extra thick tile.

If extra thick tile is desired, the wall has to be placed closer to the mixing valve fitting 18 to compensate for the extra thickness in the wall. Referring to FIG. 8, the combination plaster guard and mounting bracket 10 is removed from the fitting 18. The tubular member 14 is broken off from the mounting bracket section 12 and placed over the mixing valve 16 to abut against a fitting 18. Wall 66 is then constructed about tubular member 14 and thick tile such as ceramic tile 69 is then placed on wall 66. Tubular member 14 is then removed and holes 70 are then drilled through the tile 68 and wall 66 to align with apertures 46 in the fitting adapter 48. The screws 45 are then removed. The escutcheon plate can then be mounted in place with the screws 45 reinserted in place. A handle (not shown) is then attached to stem 75.

Figure 9:
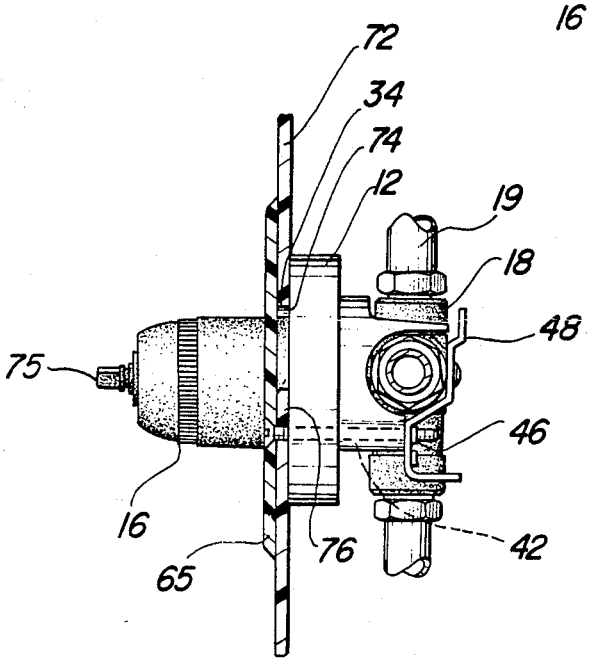
FIG. 9 is a side elevational view showing the mixing valve installed behind a fiberglass wall of a bath and shower surround or fiberglass shower unit.

The combination plaster guard and mounting bracket 10 also provides for a secure mounting to a fiberglass installation such as a shower enclosure or a bathtub and shower surround. As shown in FIG. 9, a fiberglass wall 72 has a hole 74 cut therein sized to receive the tubular member 14. Before placement of wall 72 about the tubular member 14, the screws 45 are removed from the mounting section 14 but the combination plaster guard and mounting bracket 10 maintains alignment of apertures 42 with apertures 46 by the combination of the fingers 52, legs 40 and notch 54 about the mixing valve fitting 18. The fiberglass wall is then placed over the tubular member 14 and the tubular member is then twisted so that the frangible tabs 24 are then broken and removed from the assembly. Two holes 76 are then drilled in the wall 72 aligned with the apertures 42 in the mounting legs 40. The escutcheon plate 65 is then placed in position and the mounting screws 45 are then passed through the trim 78, the wall 72 and mounting bracket section 12. The mounting bracket section 12 provides for additional support of the fiberglass wall 72 which is sandwiched between the escutcheon plate 65 and the mounting section 12. A handle (not shown) is then placed on stem 75.

Figure 11:
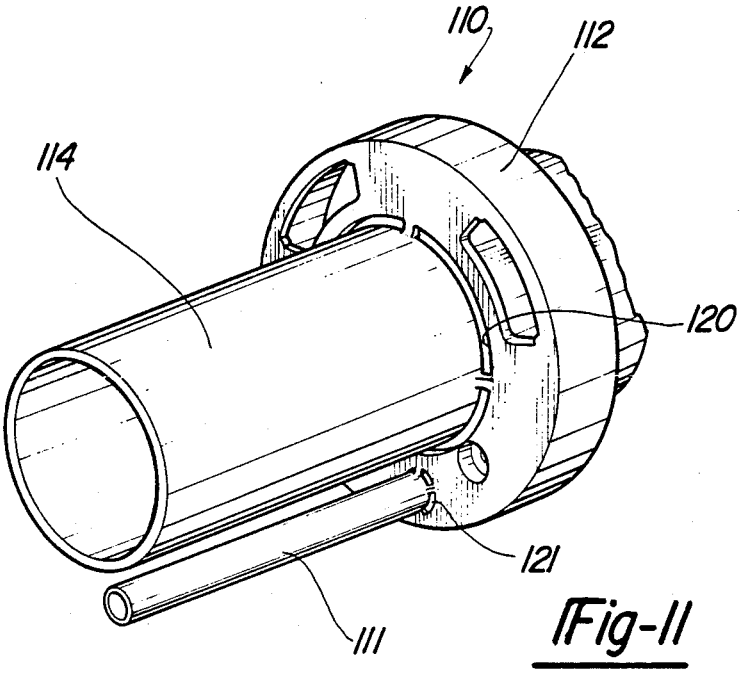
FIG. 11 is an enlarged perspective view of a second embodiment of a plaster guard mounting bracket with a second breakaway tube for a diverter valve.

A second embodiment of a combination mounting bracket and plaster guard 110 is shown in FIG. 11. The mounting bracket section 112 has two openings 120 and 121. A first breakaway tubular section 114 is positioned for receiving the mixing valve. A second breakaway tubular section 111 is sized and positioned to receive a diverter valve stem or a volume control stem that is provided in certain mixing valves. The second tubular member 111 protects the diverter valve or volume control stem the same way as the tubular member 114 protects the mixing valve body and can be used in the same fashion as the tubular member 114. Tubular member 114 is used in the same fashion as tubular member 14 previously described.

As shown, the combination plaster guard and mounting bracket 10 is suitable for a wide variety of installations of a mixing valve. The removable tubular member provides for protection of the mixing valve and then is removable so that the mounting bracket section 12 can remain in place during a standard installation or fiberglass installation. Furthermore, the tubular member can be separated from the mounting bracket and used alone for special extra thick tile installation. The mounting bracket also provides for temporary stringing or roughing in of the mixing valve before piping is attached to the valve fitting 18.

The tubular member is easily removed from the mounting section by a mere twisting and rotation o the tubular member with enough force to break the frangible tabs 24 that initially mount the tubular member 14 onto the mounting bracket section 12.

Variations and modifications of the present invention are possible without departing from the scope and spirit as defined in the appended claims.

The embodiments of the invention in which an exclusive property or privilege is claimed are defined as follows:

1. A combination plaster guard and mounting bracket assembly for a wall mounted faucet valve characterized by:

a rear mounting bracket section having mounting means for mounting onto a faucet valve assembly;

said mounting bracket section having an opening therethrough for receiving a faucet valve housing and constructed to allow the faucet valve housing to extend forwardly therefrom;

a removable tubular plaster guard member extending from said mounting bracket section and generally coaligned with said opening and sized to receive said faucet valve housing therein;

connecting means for releasably connecting said tubular member to said mounting bracket section so that said tubular member must be disconnected from said mounting bracket section and removed from about said faucet valve before installation of an escutcheon plate and a valve handle onto said valve housing.

2. A combination plaster guard and mounting bracket as defined in claim 1 further characterized by:

said tubular member being integrally formed with said mounting bracket section and said mounting means;

said connecting means for releasably connecting said tubular member to said mounting bracket section including integrally formed frangible tabs interposed between said mounting bracket section and said tubular member.

3. A combination plaster guard and mounting bracket as defined in claim 2 further characterized by:

said tubular member having an outer diameter slightly less than the diameter of said opening to provide a clearance between said tubular member and an inner edge of said mounting bracket section defining said opening;

said tabs extending radially inwardly from said inner edge to said tubular section.

4. A combination plaster guard and mounting bracket as defined in claim 3 further characterized by:

said mounting bracket having two mounting legs extending rearwardly therefrom, each mounting leg having a hole therethrough for receiving a fastener for attachment to said faucet valve assembly with said mounting legs abutting said faucet valve assembly and providing support.

5. A combination plaster guard and mounting bracket as defined in claim 4 characterized by:

said mounting bracket having integrally formed support flange extending rearwardly and conforming to abut against said faucet valve assembly and to provide in conjunction with said mounting legs stationary positioning of said plaster guard and mounting bracket against said faucet valve assembly.

6. A combination plaster guard and mounting bracket as defined in claim 5 further characterized by:

said mounting bracket being generally annular with an outer cylindrical ring and inner cylindrical ring and an annular web portion spanning the space between the inner and outer rings;

said integrally formed support flange conforming to the inner cylindrical rims and rearwardly extending therefrom.

7. A combination plaster guard and mounting bracket as defined in claim 6 further characterized by:

a plurality of support ribs extending from said inner ring to said outer ring.

8. A combination plaster guard and mounting bracket as defined in claim 7 further characterized by:

said web portion having two windows spaced between two pairs of support ribs.

9. A combination plaster guard and mounting bracket assembly for a wall mounted faucet valve characterized by:

a rear mounting bracket section having mounting means for mounting on a faucet valve assembly;

said mounting bracket section having an opening therethrough for receiving a faucet valve housing and constructed to allow the faucet valve housing to extend forwardly therefrom;

a tubular plaster guard member extending from said mounting bracket section and generally coaligned with said opening and sized to receive and protectively cover said faucet valve housing, said tubular member being releasably mounted to said mounting bracket section such that said tubular member must be removed from said mounting bracket section and removed from about said faucet valve housing before installation of an escutcheon plate and a valve handle onto said faucet valve housing.

10. A combination plaster guard and mounting bracket for a wall mounted faucet valve characterized by:

a mounting bracket section having mounting means for mounting on a faucet valve assembly;

said mounting bracket section having a first opening therethrough for receiving a faucet valve housing and a second opening for receiving a diverter stem;

a first tubular member extending from said mounting bracket section and generally coaligned with said first opening and sized to receive and protectively cover said faucet valve housing, said tubular member being releasably mounted to said mounting bracket section so that said first tubular member can be removed from said mounting bracket section and removed from about said mixing valve; and a second tubular member extending from said mounting bracket section and generally coaligned with said second opening and sized to receive said diverter valve stem, said second tubular member being releasably mounted to said mounting bracket section so that said second tubular member can be removed from said mounting bracket section and removed from about said diverter valve stem.

* * * * *